US006415130B1

(12) United States Patent
Fujiwara et al.

(10) Patent No.: US 6,415,130 B1
(45) Date of Patent: Jul. 2, 2002

(54) IMAGE FORMING APPARATUS WITH CURLING AND RECURLING MEANS

(75) Inventors: Motohiro Fujiwara, Shizuoka-ken; Toru Katsumi, Mishima; Shinya Suzuki, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/453,691

(22) Filed: Dec. 3, 1999

(30) Foreign Application Priority Data

Dec. 4, 1998 (JP) ..... 10-346243
Dec. 4, 1998 (JP) ..... 10-346244

(51) Int. Cl.[7] ..... G03G 15/01
(52) U.S. Cl. ..... 399/401; 271/188; 399/406
(58) Field of Search ..... 399/401, 406; 271/188, 209

(56) References Cited

U.S. PATENT DOCUMENTS 5,176,373 A * 1/1993 Namba ..... 271/3.1
5,572,308 A * 11/1996 Suda et al. ..... 399/401
5,905,934 A * 5/1999 Koshimizu ..... 399/396
6,032,945 A * 3/2000 Miura ..... 271/188 X

FOREIGN PATENT DOCUMENTS

JP 60-213979 10/1985
JP 9-25041 * 1/1997
JP 09-025041 1/1997
JP 10-017197 1/1998

* cited by examiner

*Primary Examiner*—Quana M. Grainger
(74) *Attorney, Agent, or Firm*—Fitzpatrick, Cella, Harper & Scinto

(57) ABSTRACT

An image forming apparatus wherein a sheet can be easily separated from a photosensitive drum both when an image is formed on one surface of a sheet and when an image is formed on the other surface, the image forming apparatus including an image forming device for using a photosensitive member to form an image on a sheet that is guided and fed along a sheet feeding path leading from a sheet stacking device, an initial curling device, positioned along the sheet feeding path, for processing the sheet so that the sheet curls away from the photosensitive member when the sheet is moved past the photosensitive member, a sheet conveying path along which the sheet, on one surface of which an image has been formed by the image forming device, is guided to the sheet feeding path, a surface reversing device, positioned along the route of the sheet conveying path, for reversing the surfaces of the sheet, and a recurling device, for processing the sheet so that the widthwise ends of the sheet curl away from the photosensitive member when the sheet delivered along the sheet conveying path is moved past the photosensitive member.

29 Claims, 8 Drawing Sheets

IMAGE FORMING APPARATUS WITH CURLING AND RECURLING MEANS

BACKGROUND OF THE INVENTION

1. Field of the Invention

The present invention relates to a both-face (i.e. duplex) image forming apparatus, such as a copier, a printer or a combination of the two, in which a front surface and a back surface of the sheet are reversed, and images are formed on both surfaces of the sheet. As used herein, duplex and both-face are used interchangeably.

2. Related Background Art

A conventional example of a both-face image forming apparatus is a copier.

The image forming processing performed by a copier 17 will be described while referring to FIG. 7. A rotatably supported image bearing member (hereinafter referred to as a photosensitive drum) 1 is rotated in the direction indicated by an arrow, while the surface is uniformly charged by a primary charger 2. Then, an image information exposure 3 is performed for the photosensitive drum 1, and an electrostatic latent image is formed on its surface. Thereafter, a developing device 4 performs a visualization process for the electrostatic latent image and produces a toner image.

Synchronized with the rotation of the photosensitive drum 1, a sheet P, which is a recording medium, is fed to the photosensitive drum 1 by registration rollers 11, and the toner image on the photosensitive drum 1 is transferred to the sheet P by a transfer charger 5. Then, the sheet P is separated from the photosensitive drum 1 by a separation charger 6. Following this, the sheet P is conveyed by a conveying unit 7 to a fixing device 8, whereat the toner image is fixed to the sheet P.

After the toner image has been transferred, the surface of the photosensitive drum 1 is cleaned by a cleaner 9, and the potential held by the photosensitive drum 1 is eliminated by a pre-exposure lamp 10. In this fashion, the photosensitive drum 1 is again prepared for the forming of another image.

The photosensitive drum 1, the primary charger 2, the image information exposure 3, the developing device 4, the transfer charger 5 and the separation charger 6, together constitute a so-called Carlson process type image forming means 16 for the copier 17, which is used to transfer a toner image from the photosensitive drum 1 to a plain paper sheet P.

For the image forming means 16, the transfer charger 5 applies, from the side opposite to the transfer surface of the sheet P contacting the photosensitive drum 1, an electrical field that has a polarity opposite to that of the charge polarity held by the toner, and thus induces the transfer of the toner image from the photosensitive drum 1 to the sheet P. Immediately after the transfer of the toner image to the sheet P by the transfer charger 5, the separation charger 6 separates the sheet P from the photosensitive drum 1. For this separation process, to eliminate the electrical charge held by the sheet P and to eliminate the attractive force existing between the sheet P and the photosensitive drum 1, the separation charger 6 applies to the sheet P an AC discharge or a DC discharge which has the same polarity as the toner. Then, the rigidity of the sheet P or its weight is employed to separate the sheet P from the photosensitive drum 1.

For a smooth separation, it is preferable that the sheet P be curled, for example, in an effective separation direction.

The effective separation direction is the direction in which, as is specifically shown in FIG. 10A, the leading end of the sheet P progresses while directed toward the separation charger 6 (away from the photosensitive drum 1) after passing through the photosensitive drum 1. The ineffective separation direction is the direction in which, as is specifically shown in FIG. 10B, reversely, the sheet P progresses while being curled around the photosensitive drum 1 and adheres to the surface of the photosensitive drum 1.

Next, the sheet conveying operation of a conventional copier 17 will be described while referring to FIG. 8.

Individual sheets P are shown in FIG. 8 so that it can be easily understood in which direction a sheet is curled when it is fed along the sheet conveying path.

Sheets P, stacked in a sheet feed cassette 14*e* and in sheet feed decks 14*a*, 14*b*, 14*c* and 14*d*, are fed to the registration rollers 11 through sheet feeding rollers 13, positioned on sheet feeding paths 50 and 51. Before a sheet P is fed to the registration rollers 11, in order to facilitate its separation from the photosensitive drum 1 it is curled a predetermined curling distance in the effective separation direction by an initial curling unit 12 or 20. By the aid of the curl, the sheet P will smoothly separate from the photosensitive drum 1. The initial curling units 12 and 20 individually comprise curling roller sets 12*a* and 12*b*, and 20*a* and 20*b*, each set of which is respectively composed of rollers having a small diameter and a large diameter.

As concerns the forming of images on both surfaces of a sheet P, a sheet P, to one surface (also called a first surface for this invention) of which an image has been fixed by the fixing device 8, is conveyed to a switchback type surface reverse portion (surface reversing means) by a flapper 15. The sheet P is routed by the surface reversing means so that it is reversed, and an image is formed on its other surface (also called a second surface for this invention). Thereafter, the sheet P is discharged from the copier 17.

The sheet P can be a sheet of plain paper, a sheet of thin resin that is substituted for plain paper, a post card, a sheet of cardboard, an envelope, or a sheet of thin plastic.

When a conventional copier 17 is employed to form images on second surfaces, however, the sheets P do not separate smoothly from the photosensitive drum 1, and there are frequent paper jams. Such jamming occurs because the sheets P are curled in the ineffective separation direction before images are formed on their second surfaces.

Assume that the measurement of the curling distance applied by the initial curing unit 12 or 20 is A (mm), and the measurement of the curling distance applied by a first R portion 18*a* and a second R portion 18*b* of the surface reverse portion 18 is B (mm).

It is expected that a sheet P will not be curled by components other than the initial curing unit 12 or 20 until it reaches the surface reverse portion 18, and that while passing through the surface reverse portion 18, the sheet P will be cooled and curled. However, while the sheet P will be curled by the first R portion 18*a*, it will seldom be curled by the second R portion 18*b*.

The measurement of the curling distance in this invention indicates the degree to which a sheet if curled, and is a value obtained by performing a measurement such as is shown in FIGS. 9A and 9B. Specifically, as is shown in FIG. 9A, the curled sheet P is suspended, its curled edge Pa held horizontally, and the shape formed by the curled sheet is written on a horizontal plate 19, as is shown in FIG. 9B. Then the distance L, between a line D connecting the upstream end Pb and the downstream end Pc in the sheet conveying direction and the surface of the curled portion farthest from the line D, is measured, and the obtained value is used as the curling distance.

The curling distance for the first surface is the curling distance A (mm) in the effective separation direction. The curling applied to the first surface acts with the curling applied by the first R portion 18*a* to the second surface in the ineffective separation direction, and only the initial curling unit 20 acts in the effective separation direction. Thus, the curling distance is −A−B+A=−B (mm).

As is described above, with a conventional copier, while the first surface of a sheet can be satisfactorily separated from the photosensitive drum 1, the direction of the curling of the first surface applied by the initial curling unit 12 or 20 is opposite to the direction of the curling applied to the second surface by the initial curling unit 20. As a result, the effect provided by the curling rollers in the initial curling unit 12 or 20 is not offset for the second surface, and only the curling applied by the first R portion 18*a* in the ineffective separation direction remains.

Therefore, for a conventional image forming apparatus, separating a sheet from the photosensitive drum is difficult, and paper jams occur easily.

Furthermore, since as is shown in FIG. 11 the rollers 12*a* and 20*a*, which have small diameters, are longer than the large diameter rollers 12*b* and 20*b* and are apt to slightly bent, the pressure with which the ends of the roller 12*b*, or 20*b*, are pressed against a sheet may be greater than the pressure with which the intermediate portion of the roller 12*b*, or 20*b*, is pressed against the sheet.

Therefore, both ends of the sheet in the widthwise direction of the sheet are excessively curled, which prevents the sheet from being uniformly attached to the photosensitive drum 1. Accordingly, during the transfer process an aberration of the sheet may occur, or an image formed on the sheet may be blurred.

SUMMARY OF THE INVENTION

It is, therefore, an object of the present invention to provide a both-face image forming apparatus wherein, during the image forming process, the first surface of a sheet is curled in the effective separation direction to ensure its satisfactory separation from a photosensitive member, and in addition, the second surface of the sheet is also curled in the effective separation direction to ensure its satisfactory separation.

It is another object of the present invention to provide a both-face image forming apparatus wherein an aberration of a sheet and the blurring of images formed on sheets are prevented by suppressing the tendency to produce excessive curling at the ends of sheets.

To achieve the above objects, according to the present invention, an image forming apparatus comprises:

sheet stacking means for stacking sheets;

image forming means for forming an image, by a photosensitive member, on a sheet that is guided and fed along a sheet feeding path from the sheet stacking means;

initial curling means, positioned on the sheet feeding path, for curling the sheet in a direction away from the photosensitive member when the sheet passes through the photosensitive member;

a sheet conveying path along which the sheet, on one surface of which an image has been formed by the image forming means, is guided to the sheet feeding path;

surface reversing means, positioned on the sheet conveying path, for reversing a front surface and a back surface of the sheet; and recurling means, positioned on the sheet conveying path, for curling the widthwise ends of the sheet in a direction away from the photosensitive member when the sheet delivered along the sheet conveying path passes through the photosensitive member.

In the both-face image forming apparatus, a sheet is fed along the sheet feeding path to the image forming means, and an image is formed on one surface of the sheet. During this feed of the sheet, the sheet is initially curled by the initial curling means in the direction that facilitates the separation of the sheet from the photosensitive member after the sheet has been past it, i.e., the direction in which the upstream end and the downstream end of the sheet in the sheet feeding direction are separated from the photosensitive member. That is, the sheet is curled in the effective separation direction.

Therefore, after an image has been formed on one surface, the sheet can be smoothly removed from the photosensitive member.

However, at this time the widthwise ends of the sheet, which were curled by the initial curling means, are curled toward the photosensitive member, and thereby, closely attaching the widthwise intermediate portion of the sheet to the photosensitive member would be difficult.

In the both-face image forming apparatus, after an image has been formed on one surface of a sheet, the surfaces of the sheet are reversed by the surface reversing means. But by reversing the sheet, the reversing means sets it so it is curled in the ineffective separation direction. Therefore, while the sheet is passing along the delivery route extending from the reversing means to the image forming means, the recurling means curls the sheet so it is again curled in the effective separation direction. At the same time, the curls at the widthwise ends of the sheet are removed and the ends are flattened, so that the image forming means can form an image on the other surface of the sheet.

The recurling means may also be positioned on the sheet conveying path upstream of the reversing means. In this case, when the sheet reaches the reversing means it has already been recurled, and thus, at the reversing means it is curled in the direction that is the opposite of that in which it was curled by the recurling means. However, since some of the curl applied by the recurling means is retained by the sheet, it is not difficult to separate it from the photosensitive member after an image has been formed on the second surface.

Therefore, compared with the conventional apparatus, the both-face image forming apparatus of this invention employs the recurling means for recurling the sheet in the effective separation direction, and to flatten it in the widthwise direction. Thus, after the image forming means has formed an image on the other surface of the sheet, the sheet can more easily be separated from the photosensitive member than can a sheet in the conventional art.

For the both-face image forming apparatus of this invention, the recurling means may be located between the initial curling means, which is positioned on the sheet feeding path leading from the sheet stacking means that is nearest the surface reversing means, and the sheet stacking means.

For the both-face image forming apparatus, since a sheet fed from the sheet stacking means nearest the surface reversing means is curled by both the recurling means and the initial curing means before an image is formed on one surface of the sheet, the sheet can easily be separated from the photosensitive member.

For the both-face image forming apparatus of this invention, the recurling means may be located between the surface reversing means and the sheet stacking means nearest the surface reversing means.

For the both-face image forming apparatus, since the recurling means is located between the surface reversing means and the sheet stacking means nearest the surface reversing means, the same curling measurement can be provided for all the sheets that are recurled.

For the both-face image forming apparatus, the initial curling means and the recurling means have a roller having a large diameter and a roller having a small diameter for holding and curling a sheet. The length of the roller of the recurling means that has a large diameter is shorter than the width of the sheet, and is greater than the length of the roller of the initial curling means that has a large diameter.

In the both-face image forming apparatus, the recurling means curls the sheet to remove the curl applied by the initial curling means at the widthwise ends of the sheet.

For the both-face image forming apparatus of this invention, the roller having a large diameter may be more elastic than the roller having a small diameter.

For the both-face image forming apparatus of this invention, provided at both ends of the roller having a large diameter are holding rollers that contact the roller having a small diameter when the roller having a large diameter is elastically deformed by the roller having a small diameter. The total length of the roller having a large diameter and the holding rollers, and the length of the roller having a small diameter may be set equal to or greater than the width of the sheet.

In the both-face image forming apparatus, when the roller having a large diameter is elastically deformed by the roller having a small diameter, and after in the feeding direction the upstream end and the downstream end of the sheet are curled, the roller having a small diameter feeds the sheet by contacting the holding rollers via the widthwise ends of the sheet.

For the both-face image forming apparatus, the roller having a small diameter is made of a hard metal, and the roller having a large diameter is made of sponge.

In the both-face image forming apparatus, the sheet is curled by pushing a part of the roller having a small diameter into the roller having a large diameter.

For the both-face image forming apparatus of this invention, the depth to which the roller of the recurling means having a small diameter bites into the roller having a large diameter is greater than the depth to which the roller of the initial curling means having a small diameter bites into the roller having a large diameter.

For the both-face image forming apparatus of this invention, the force with which the roller having a small diameter of the recurling means presses against the roller having a large diameter is greater than the force with which the roller having a small diameter of the initial curling means presses against the roller having a large diameter.

For the both-face image forming apparatus of the present invention, the roller of the recurling means having a large diameter may be more elastic than the roller of the initial curling means having a large diameter.

For the both-face image forming apparatus of the present invention, the diameter of the roller of the recurling means having a small diameter may be smaller than the diameter of the roller of the initial curing means having a small diameter.

For the both-face image forming apparatus, when the recurling means curls a sheet, it provides a greater curling distance than does the initial curling means. Thus, the sheet that has been curled by the surface reversing means in the direction in which it can be ineffectively separated from the photosensitive member is now curled in the direction in which it can be easily separated.

For the both-face image forming apparatus, the initial curling means and the recurling means may each include a pair of pressing rollers separately positioned in the sheet feeding direction, and one pressed roller that is located between the pair of pressing rollers to receive pressure applied by the pair of pressing rollers.

In the both-face image forming apparatus, the pair of pressing rollers and the pressed roller nip and convey the sheet. At this time, the sheet is curled by the application of a curling force.

For the both-face image forming apparatus of this invention, the distance to which the pressed roller of the recurling means enters the space between the pair of pressing rollers may be greater than the distance to which the pressed roller of the initial curling means enters the space between the pair of pressing rollers.

In the both-face image forming apparatus, when curling a sheet the recurring means provides a greater curling distance than does the initial curling means. Therefore, a sheet that has been curled by the surface reversing means in the direction in which it can not be smoothly separated from the photosensitive member is then curled in the direction in which it can be easily separated.

For the both-face image forming apparatus, the length of the pair of pressing rollers of the recurling means is shorter than the width of the sheet, and is greater than the length of the pair of pressing rollers of the initial curling means.

The both-face image forming apparatus employs the recurling means to flatten the widthwise ends of the sheet.

For the both-face image forming apparatus of this invention, the initial curling means and the recurling means may each include a roller having a large diameter and a roller having a small diameter for nipping and curling a sheet, and the roller having a large diameter may be more elastic than the roller having a small diameter.

For the both-face image forming apparatus, the roller having a small diameter is made of metal, and the roller having a large diameter is made of sponge.

In the both-face image forming apparatus, the sheet is curled by pushing a part of the roller having a small diameter into the roller having a large diameter.

For the both-face image forming apparatus of this invention, the depth to which the roller of the recurling means having a small diameter bites into the roller having a large diameter is greater than the depth to which the roller of the initial curling means having a small diameter bites into the roller having a large diameter.

For the both-face image forming apparatus of this invention, the force with which the roller having a small diameter of the recurling means presses against the roller having a large diameter is greater than the force with which the roller having a small diameter of the initial curling means presses against the roller having a large diameter.

For the both-face image forming apparatus of the present invention, the roller of the recurling means having a large diameter may be more elastic than the roller of the initial curling means having a large diameter.

For the both-face image forming apparatus of the present invention, the diameter of the roller of the recurling means having a small diameter may be smaller than the diameter of the roller of the initial curing means having a small diameter.

For the both-face image forming apparatus, when the recurling means curls a sheet it provides a greater curling distance than does the initial curling means. Thus, the sheet that has been curled by the surface reversing means in the direction in which it can be ineffectively separated from the photosensitive member is now curled in the direction in which it can be easily separated.

For the both-face image forming apparatus, the initial curling means and the recurling means may each include a pair of pressing rollers separately positioned in the sheet feeding direction, and one pressed roller that is located between the pair of pressing rollers to receive pressure applied by the pressing rollers.

In the both-face image forming apparatus, the pair of pressing rollers and the pressed roller nip and convey the sheet. At this time, the sheet is curled by the application of a curling force.

For the both-face image forming apparatus of this invention, the distance to which the pressed roller of the recurling means enters the space between the pair of pressing rollers may be greater than the distance to which the pressed roller of the initial curling means enters the space between the pair of pressing rollers.

In the both-face image forming apparatus, when curling a sheet the recurling means provides a greater curling distance than does the initial curling means. Therefore, a sheet that has been curled by the surface reversing means in the direction in which it can not be smoothly separated from the photosensitive member is then curled in the direction in which it can be easily separated.

For the both-face image forming apparatus, the curling capability of the recurling means may be greater than the curling capability of the initial curling means.

DETAILED DESCRIPTION OF THE PREFERRED EMBODIMENTS

Figure 1:
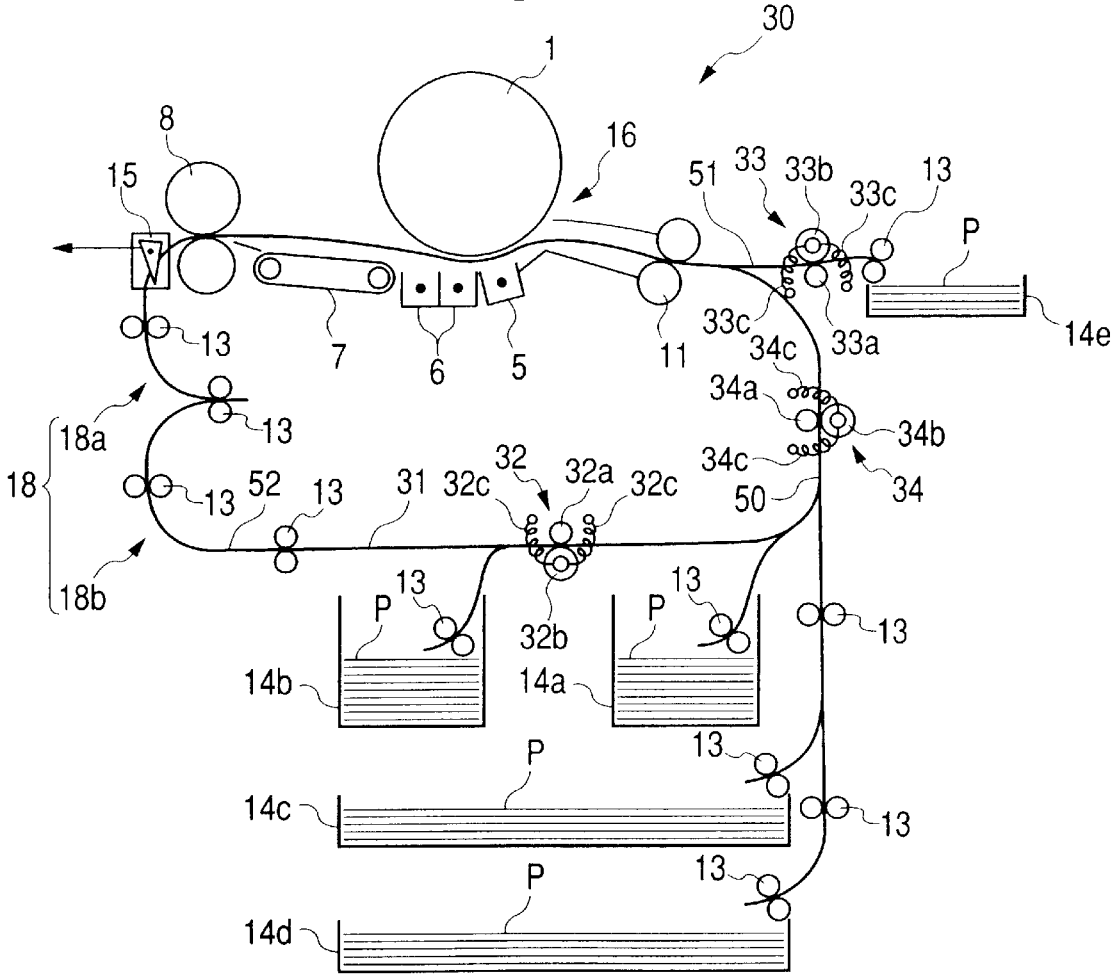
FIG. 1 is a front schematic cross-sectional view of a copier that is a both-face image forming apparatus according to an embodiment of the present invention.

The preferred embodiments of the present invention will now be described while referring to FIGS. 1 to 4.

The same reference numerals as are used for the conventional art are used to denote corresponding components, and only the portions that differ from those of the conventional copier 17 will be explained. Numerical values used in the following explanation are merely examples, and are used for reference only; other values may be employed.

A copier (both-face image forming apparatus) 30 for a first embodiment differs from the conventional copier 17 in that a recurling unit 32 for the second surface of a sheet is positioned on a sheet feeding path 50 extending between a photosensitive drum 1 and a sheet feeding deck 14*b* that is nearest a surface reversing unit (surface reversing means) 18.

With this arrangement, a sheet P other than a sheet P fed from the left deck 14*b* is fed by sheet feeding rollers 13 from sheet feed cassette 14*e* or one of the decks 14*a*, 14*c* and 14*d*, and is curled by initial curling units 33 and 34 for the first surface. The sheet is then fed to registration rollers 11, and an image is formed on the first surface of the sheet P.

Then, only a sheet P for which image forming is required on the first surface only is conveyed and discharged to the outside of the apparatus by a flapper 15. A sheet P for which the forming of an image on the second surface has been requested is delivered to a surface reversing unit 18.

The surfaces of the sheet P are reversed and the sheet P is curled by a first R portion 18*a* and a second R portion 18*b*, and is then curled by the recurling unit 32 for the second surface and the initial curling unit 34 for the first surface. Thereafter, the curled sheet P is fed to the registration rollers 11, and an image is formed on the second surface by the photosensitive drum 1. The resultant sheet is thereafter conveyed to the outside and discharged.

When the curling distance provided by the recurling unit 32 for the second surface is defined as C (mm), the curling distance for the second surface acts in the effective separation direction, and the curling distance when the sheet P reaches the photosensitive drum 1 is $-A-B+C+A=-B+C$ (mm).

The curling distance provided by the initial curling unit 33 for the first surface is defined as A (mm), and the curling distance provided by the first R portion 18*a* and the second R portion 18*b* of the surface reversing unit 18 is defined as B (mm).

In order to obtain the same separation for the second surface as for the first surface, a curling distance equal to or greater than A (mm) is required for the second surface. That is, $[(-B+C)>A]=[C>(A+B)]$ is required.

Since B is a positive value in the above inequality, at the least the relationship $C>A$ must be established. That is, the curling distance provided by the recurling unit 32 for the second surface must be greater than the curling distance provided by one of the initial curling units 33 and 34 for the first surface.

Figure 2:
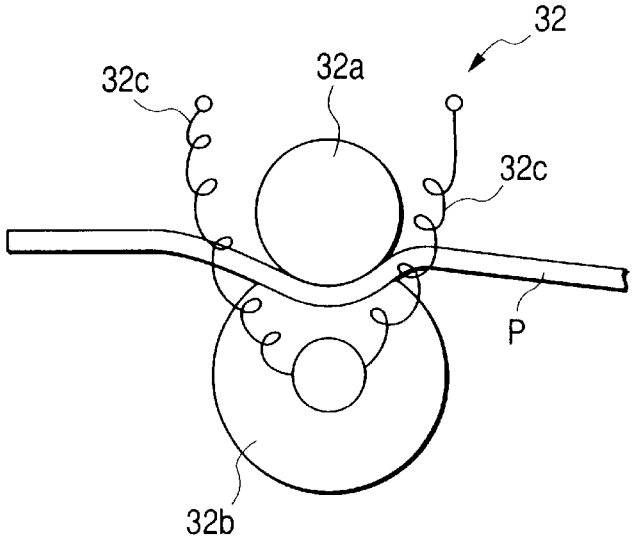
FIG. 2 is a front view of a recurring unit.

The arrangement of the recurling unit 32 for processing the second surface will now be described while referring to FIG. 2. Since the arrangements for the initial curling units 33 and 34 for the first surface are substantially the same, no explanation for them will be given.

The recurling unit 32 includes a curling roller 32*a* made of iron and having a smaller diameter; a curling roller made of sponge and having a larger diameter larger than the curling roller 32*a*; and a spring 32*c* for pressing the sponge roller 32*b* against the iron roller 32*a*. The iron roller 32*a* is fixed to the main body of the apparatus.

Therefore, the curling roller 32*a* having a small diameter bites into the curling roller 32*b* having a large diameter. And as a sheet P passes the biting portion, the sheet P is pushed against and curled around the iron roller 32*a*.

In this embodiment, the diameters of the iron rollers 32*a*, 33*a* and 34*a* for the first and the second surfaces are approximately 8 mm, and the diameters of the sponge rollers 32*b*, 33*b* and 34*b* are approximately 20 mm.

In order to apply different curling forces, springs having a spring constant of about 0.135 N/mm are employed as the springs 33*c* and 34*c* for the curling rollers for the first surface, while a spring having a spring constant of about 0.196 N/mm is employed as the spring 32*c* for the roller for the second surface. Therefore, the force with which the curling rollers 33*a* and 34*b* for the first surface having small diameters bite into the curling rollers 33*b* and 34*b* for the first surface having large diameters is approximately 3 kg weight, and the force with which the curling roller 32*a* having a small diameter bites into the curling roller 32*b* for the second surface having a large diameter is approximately 39 N (4 kg weight). A curling distance of approximately 10 mm is applied to a sheet P by the initial curling units 33 and 34 for the first surface, and one of approximately 20 mm is applied to the sheet P by the recurling unit 32 for the second surface.

With the above arrangement, the curling distance of a sheet P at the location whereat the sheet P separates from the photosensitive drum 1 is approximately 10 mm for the first surface, and is also approximately 10 mm in the effective separation direction for the second surface, so that the conveying of the sheet is very satisfactorily performed.

It should be noted that when a sheet P is fed from the left deck 14*b* the sheet P passes through the recurling unit 32 for the second surface, even when the image forming that is performed is for the first surface, and the curling distance is not those described above but is approximately 32 mm for the first surface and approximately −10 mm for the second surface.

Thus, if a less rigid sheet P is fed from the left deck 14*b*, in the second surface image forming process, sheet separation may be unstable. Therefore, in order to obtain the satisfactory separation of not only a sheet fed from the left deck 14*b*, but also any other sheet bearing an image on the second surface, it is preferable that the recurling unit 32 for the second surface be located upstream of the left deck 14*b*, i.e., on a reversed sheet conveying path 31 that connects the sheet feeding path 50 and the surface reversing means 18, as is shown in FIG. 3, and that in any case, a sheet P be prevented from passing through the recurling unit 32 for the second surface until image forming on the first surface of the sheet P has been completed.

Figure 3:
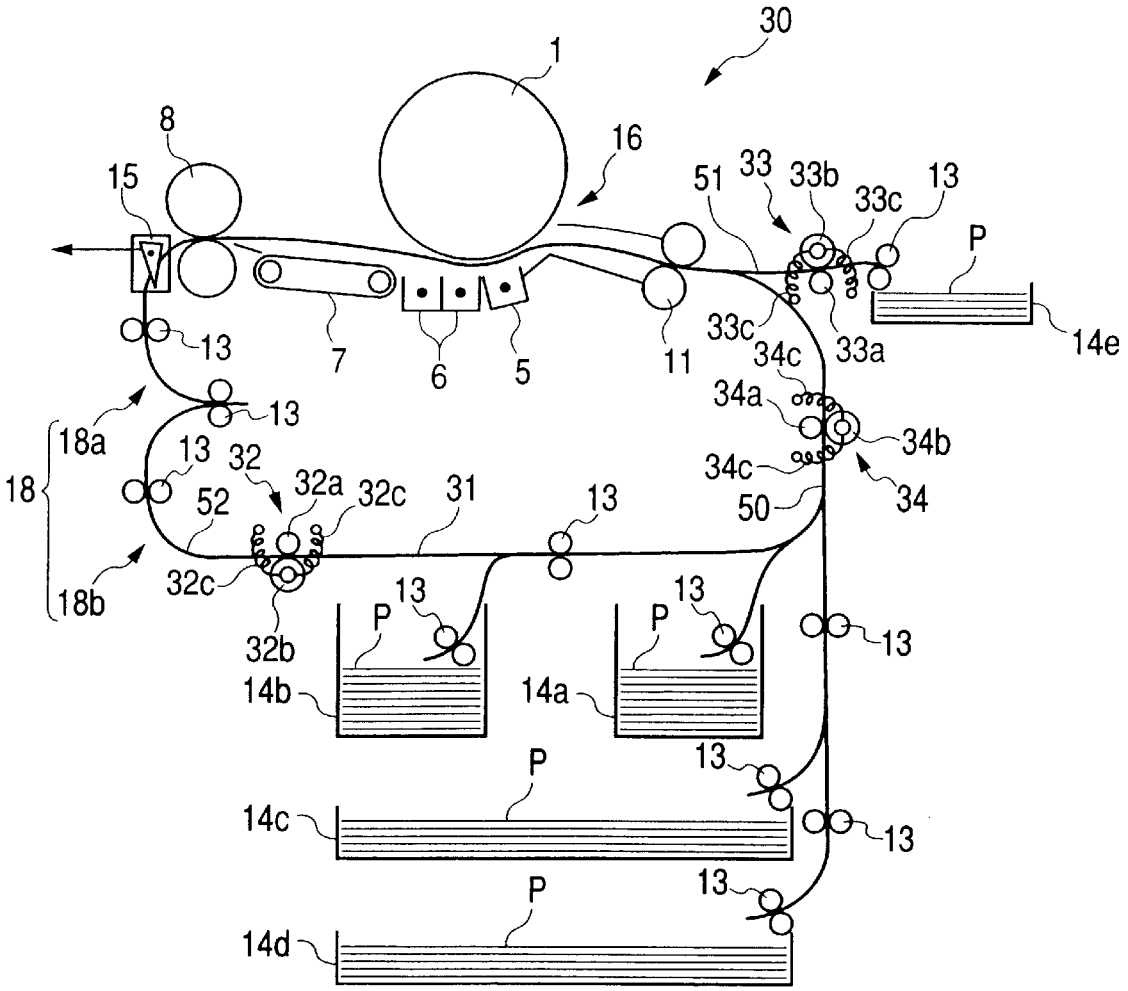
FIG. 3 is a front schematic cross-sectional view of the copier in FIG. 1 wherein the location of the recurling unit has been changed.

Also, in the arrangement in FIG. 3, wherein the recurling unit 32 for the second surface is located upstream of the left deck 14*b*, since the curling distance applied by the recurling unit 32 for the second surface is greater than the curling distance applied by the initial curling units 33 and 34 for the first surface, any type of sheet can be satisfactorily separated during the image forming performed for both the first surface and the second surface.

As is described above, according to the present invention, it is important that the curling distance applied by the recurling unit 32 for the second surface be greater than that applied by the initial curling units 33 and 34 for the first surface, and the object of the present invention is attained by changing the spring constants of the springs 33*c*, 34*c* and 32*c* for the curling rollers. The object of the present invention can also be attained by setting the diameter of the iron roller 32*a* for the second surface so that it is smaller than the diameters of the iron rollers 33*a* and 34*a* for the first surface, or by setting the hardness of the sponge roller 32*b* for the second surface so that it is less than the hardness of the sponge roller 33*b* or 34*b* for the first surface.

Further, to attain the object of the present invention, since the curling distance is determined by the depth to which the iron rollers 33*a*, 34*a* and 32*a* bite into (enter) the sponge rollers 33*b*, 34*b* and 32*b*, instead of providing the springs 33*c*, 34*c* and 32*c* for the curling rollers, the rollers are so positioned that the depth to which the iron roller 32*a* for the second surface enters the sponge roller 32*a* is greater than the depth to which the iron rollers 33*a* and 34*a* for the first surface enter the sponge rollers 33*b* and 34*b*.

Figure 4:
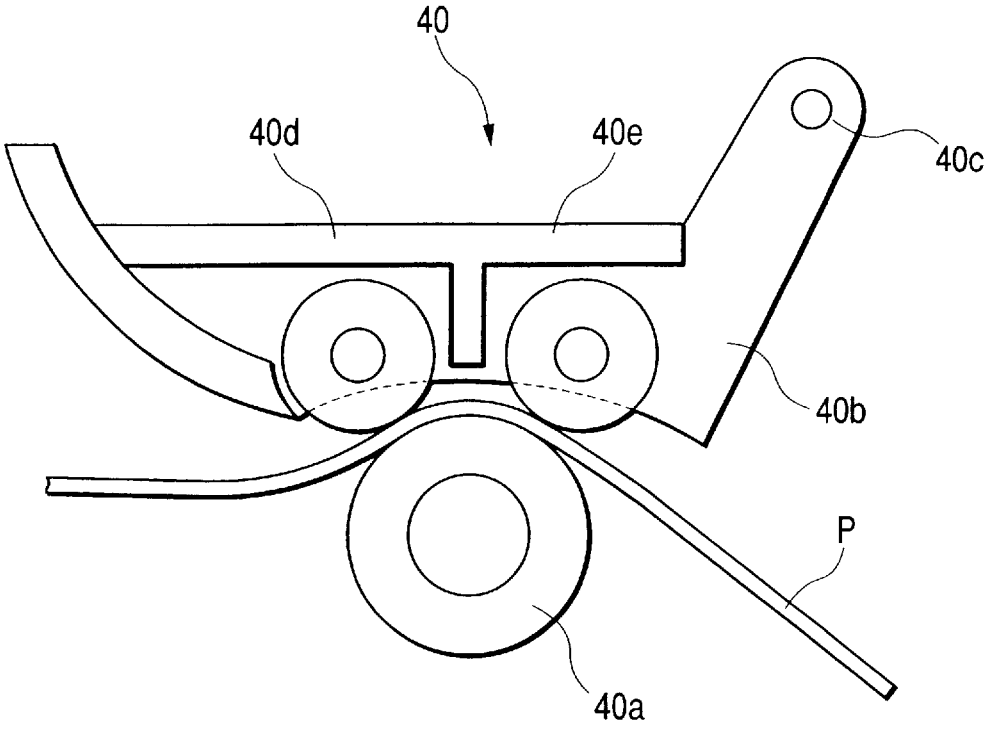
FIG. 4 is a front schematic view of a recurling unit according to another embodiment of the present invention.

FIG. 4 is a diagram showing a recurling unit 40, a modification of the recurling unit 32.

The recurling unit 40 includes a lower roller 40*a*; a holder 40*b*, which rotates around a rotary shaft 40*c* and is urged toward the lower roller 40*a*; and two rollers 40*d* and 40*e*, which are mounted on the holder 40*b*. When a sheet P is passed between the two rollers 40*d* and 40*e* and the lower roller 40*a*, which has entered the space between the rollers 40*d* and 40*e*, the sheet P is pushed against and curled around the lower roller 40*a*.

The lower roller 40*a* has a jaw (not shown) of about 0.5 mm hight that increases its capability to discharge a sheet P.

The initial curing units 33 and 34 may be arranged the same as the recurling unit 40 in FIG. 4. In this case, since the curling distance applied to a sheet by the recurling unit 40 must be greater than that applied by the initial curling units, the distance to which the lower roller of the recurling unit 40 advances into the space between the two upper rollers must be increased.

In addition, the recurling unit 32 or 40 may be located on the sheet conveying path 52 upstream of the surface reversing means 18. In this case, the sheet is recurled by the recurling unit in the effective separation direction, but when the sheet passes through the surface reversing means 18, the sheet is again curled by the surface reversing means 18 and part of the recurling is canceled. However, since the curling applied to the sheet by the recurling unit 32 or 40 is more or less retained, no difficulty is encountered in separating from the photosensitive member 1 the sheet bearing an image on the second surface. In this arrangement, the sheet conveying path 52 includes a conveying path, extending from the flapper 15 to the sheet feeding path 50 for the sheet feed deck 14*b*, that includes the surface reverse means 18 and the reversed sheet conveying path 31.

In the above embodiment, the photosensitive drum 1 is employed as a photosensitive member. Besides the drum, a flat photosensitive. member is available, and the present invention can include either a drum type or a flat photosensitive member.

Figure 5:
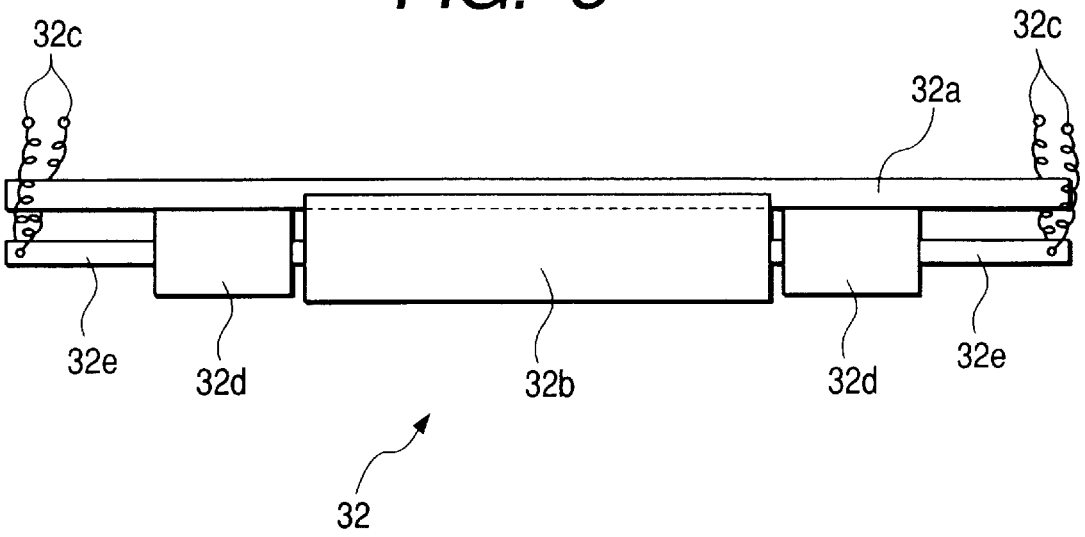
FIG. 5 is a diagram showing the recurling unit looking in a sheet feeding direction.

An explanation will now be given in conjunction with FIG. 5 for a recurling unit 32 for a second surface according to a second embodiment of the present invention that applies to a sheet curling that has a greater curling distance than that applied by the initial curling units 33 and 34 for the first surface.

The recurling unit 32 includes a curling roller 32*a*, which is an iron roller having a small diameter; a curling roller 32*b*, which is a sponge roller having a large diameter larger than that of the curling roller 32*a*; and a spring 32*c* for pressing the sponge roller 32*b* against the iron roller 32*a*. The iron roller 32*a* is fixed to the main body of the apparatus.

The sponge roller 32*b* is shorter than the width of a sheet (approximately 300 mm) that passes through the rollers.

Thus, the bending of the small iron roller 32*a* is reduced, and excessive curling at the ends of the sheet is prevented. However, there may be a reduction in the conveying force applied at the ends of the roller 32*b*.

Therefore, as auxiliary conveying means, collars 32*d*, which have substantially the same diameter as has the sponge roller 32*b* when the iron roller 32*a* bites into the sponge roller 32*b*, are loosely fitted on a support shaft 32*e* of the sponge roller 32*b* at either end of the sponge roller 32.

The arrangement of the initial curling unit 33 or 34 for the first surface is the same as that of the recurling unit 32 for the second surface, except for the portion explained below.

As the most important feature of this embodiment, the sponge rollers 33*b* and 34*b* for the first surface are shorter than the sponge roller 32*b* for the second surface (the end-cut lengths of the rollers 33*b* and 34*b* are longer than the end-cut length of the roller 32*b*).

In this embodiment, the lengths of the sponge rollers 33*b* and 34*b* for the first surface are approximately 200 mm (an end-cut length of about 100 mm), and the length of the sponge roller 32*b* for the second surface is approximately 240 mm (an end-cut length of about 60 mm).

An explanation will now be given for the reason the sponge rollers 33*b* and 34*b* for the first surface are shorter than the sponge roller 32*b* for the second surface (the end-cut length is longer).

First, the diameter of the sponge roller 32*b* for the second surface is greater than the diameters of the sponge rollers 33*b* and 34*b* for the first surface, so that the curling distance applied by the recurling unit 32 for the second surface is greater than the curling distance applied by the initial curling units 33 and 34 for the first surface. The curling at the ends of the sheet tends to cause the formation of a blurred image or a blank area due to a poor transfer effect, more often than the curling in the intermediate portion of the sheet in the widthwise direction. However, the curling at the ends of the sheet can also furnish a starting point for the separation of the sheet from the photosensitive drum 1, and may promote separation.

Therefore, when forming an image on the second surface, which is more difficult to separate, the ends of the sheet must be intentionally curled to cancel out the curling provided by the initial curling unit 33 or 34.

Furthermore, since the curling rollers 33*b* and 34*b* for the first surface are located closer to the photosensitive drum 1, blank areas due to poor transfer effects or blurred images tend to appear more frequently if the ends of sheets are curled too much. Thus, the curling distance at the ends of sheets must be reduced until it is less than that provided by the curling roller 32*b* for the second surface.

In this embodiment, the diameters of the iron rollers 32*a*, 33*a* and 34*a* for the first and the second surfaces are approximately 8 mm, and the diameters of the sponge rollers 32*b*, 33*b* and 34*b* are approximately 20 mm.

In order to apply different curling forces, springs having a spring constant of about 0.135 N/mm are employed as the springs 33*c* and 34*c* for the curling rollers for the first surface, while a spring having a spring constant of about 0.196 N/mm is employed as the spring 32*c* for the curling roller for the second surface. Therefore, the force with which the curling rollers 33*a* and 34*b* , which have a small diameter, bite into the curling rollers 33*b* and 34*b* having a large diameter for the first surface is approximately 3 kg weight, and the force with which the curling curling roller 32*a*, which has a small diameter, bites into the curling rollers 32*b*, which have a large diameter for the second surface, is approximately 39 N (4 kg weight). The curling distance for the first surface that is applied to the sheet P by the initial curling units 33 and 34 is approximately 10 mm, and for the curling distance applied by the recurling unit 32 for the second surface is approximately 20 mm.

As is described above, the length of the sponge roller 33*b* for the first surface is approximately 200 mm, the length of each collar 33*d* located at either end of the roller 33*b* is about 50 mm, and the diameter of the collar 33*d* is about 6.5 mm. Further, the length of the sponge roller 32*b* for the second surface is approximately 240 mm, the length of each collar 32*d* located at either end of the roller 32*b* is about 30 mm, and the diameter of the collar 32*d* is about 6 mm.

With the above arrangement, the curling distance of a sheet P at a location where it separates from the photosensitive drum 1 is approximately 10 mm for the first surface, and the curling distance for the second surface in the effective separation direction is also approximately 10 mm, so that the sheet is conveyed very satisfactorily. A blank area or a blurred image due to curling at the ends of a sheet P seldom occurs during the image forming process for the first surface and the second surface.

It should be noted that only when a sheet P is fed from the left deck 14*b* is the sheet P passed through the recurling unit 32 for the second surface, even for image forming performed for the first surface. And the curling distance is also not the same as those described above, but is approximately 32 mm for the first surface and approximately −10 mm for the second surface.

Figure 6:
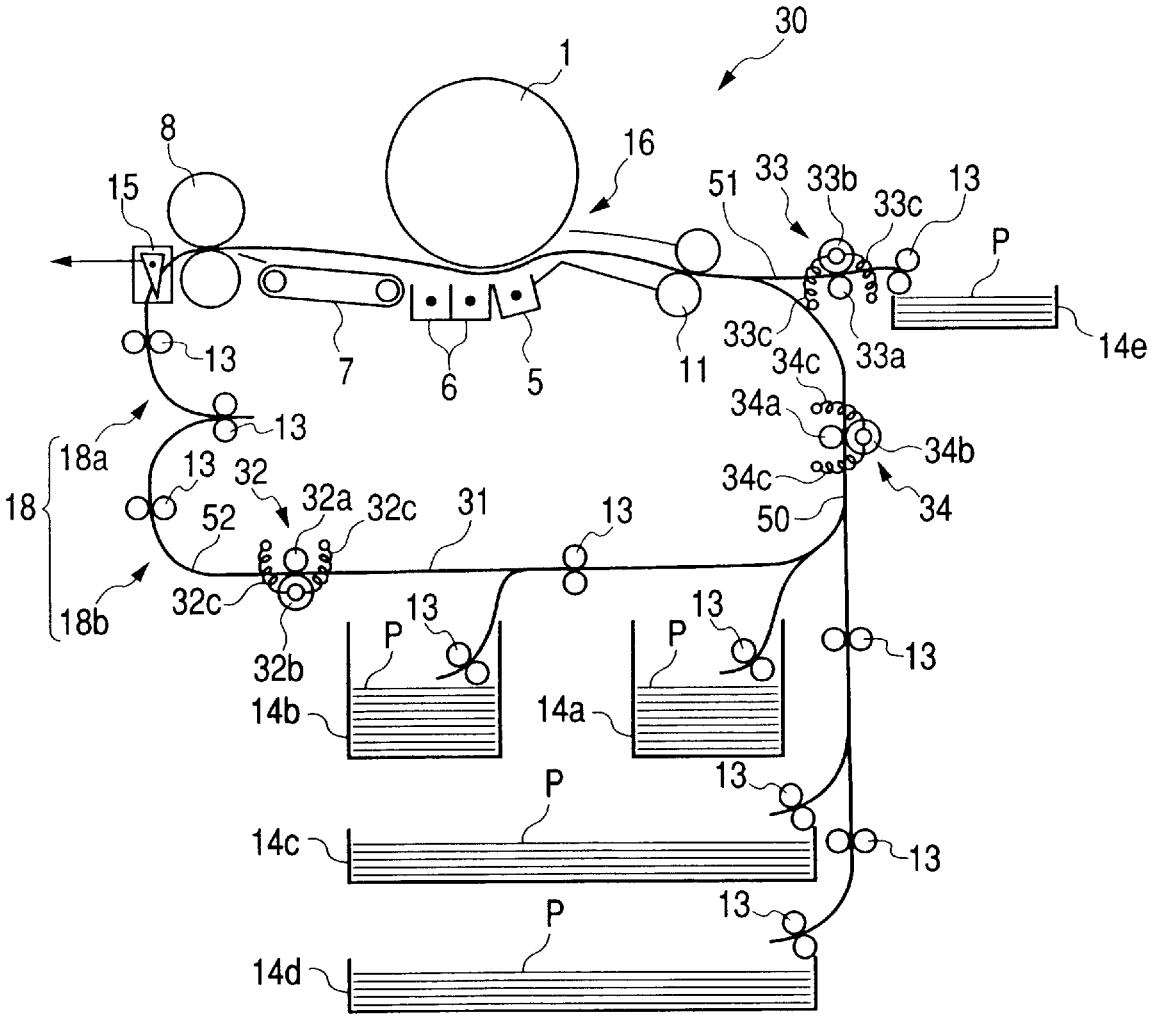
FIG. 6 is a front schematic cross-sectional view of the copier in FIG. 1 wherein the location of the recurling unit has been changed.
Figure 7:
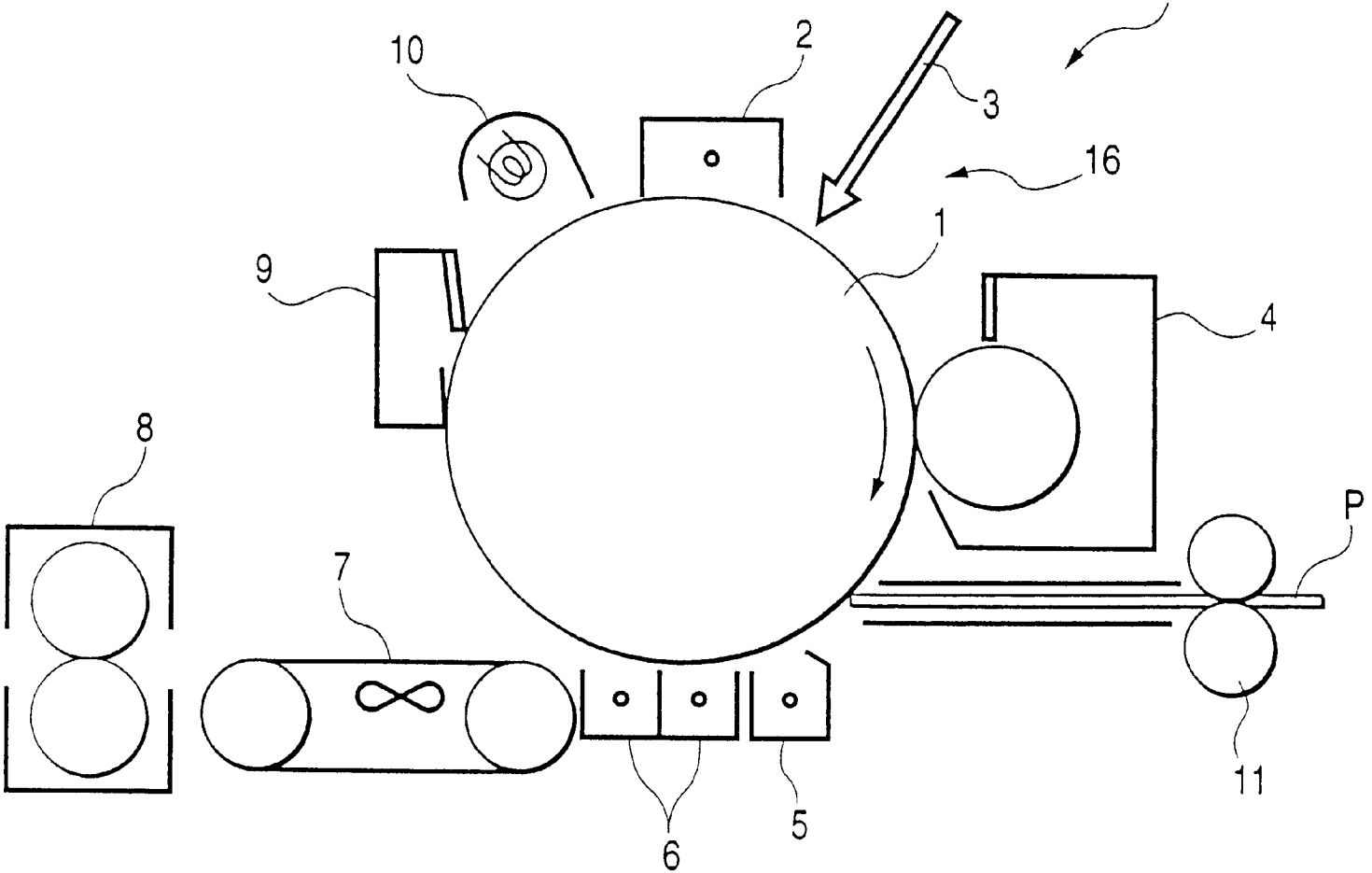
FIG. 7 PRIOR ART
FIG. 7 is a detailed diagram illustrating a conventional image forming means.
Figure 8:
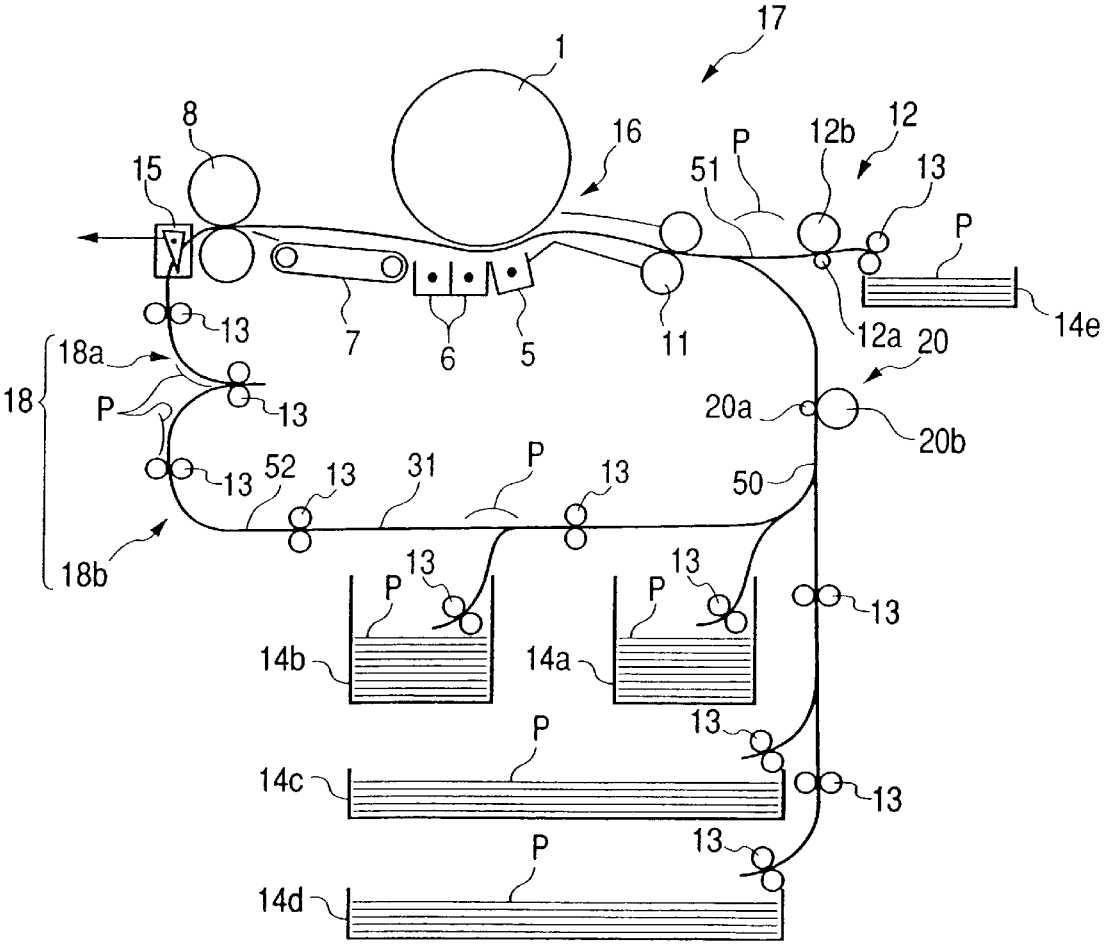
FIG. 8 PRIOR ART
FIG. 8 is a front schematic cross-sectional view of a copier which is a conventional image forming apparatus.
Figure 9A:
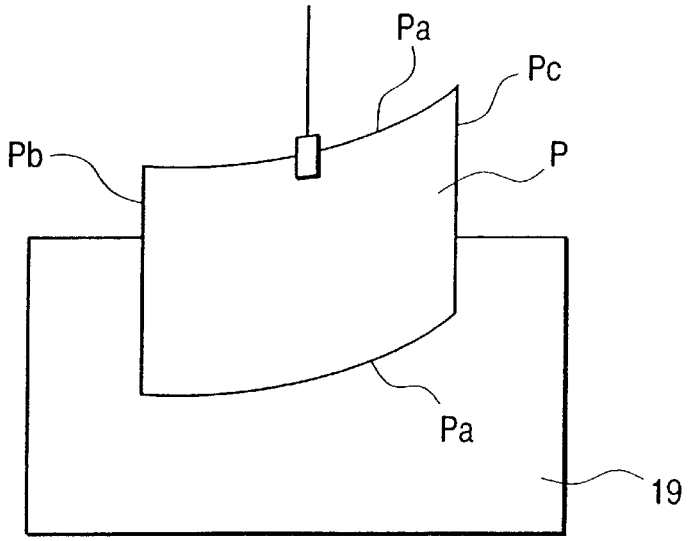
FIG. 9A PRIOR ART
FIG. 9A is a perspective view of a method for measuring a curling distance.
Figure 9B:
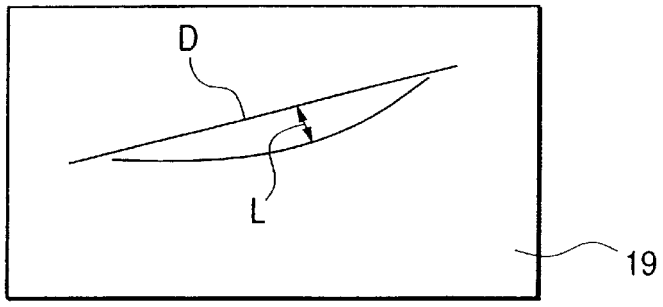
FIG. 9B PRIOR ART
FIG. 9B is a plan view of the method for measuring a curling distance.
Figure 10A:
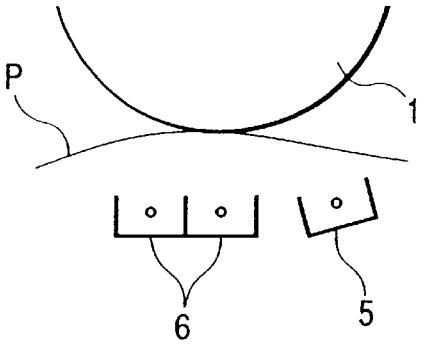
FIG. 10A PRIOR ART
FIG. 10A is a specific diagram showing a curl in the effective separation direction relative to a photosensitive drum that is a photosensitive member.
Figure 10B:
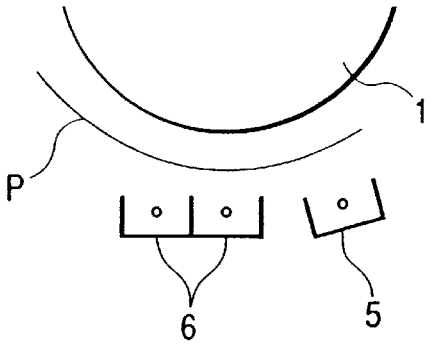
FIG. 10B PRIOR ART
FIG. 10B is a specific diagram showing a curl in the ineffective separation direction relative to a photosensitive drum that is a photosensitive member.
Figure 11:
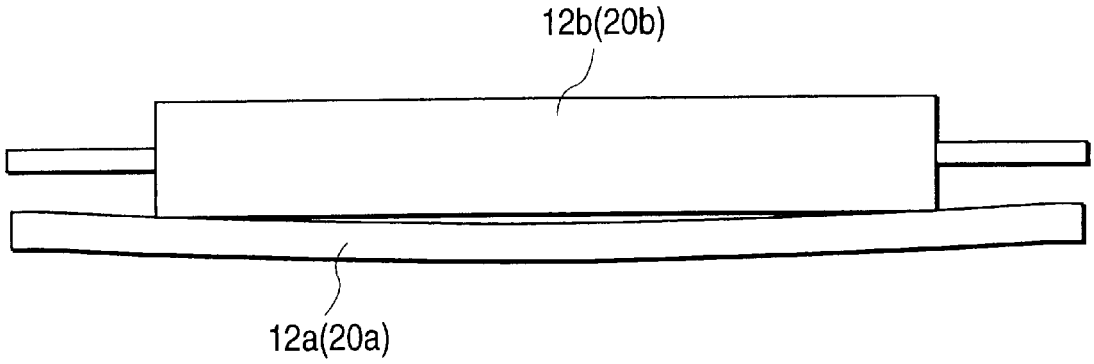
FIG. 11 is a diagram showing conventional initial curling means looking in a sheet feeding direction.

Thus, if a less rigid sheet P is fed from the left deck 14*b*, in the second surface image forming process, sheet separation may be unstable. Therefore, in order to obtain a satisfactory separation of not only a sheet fed from the left deck 14*b*, but also of any other sheet bearing an image on the second surface, it is preferable that the recurling unit 32 for the second surface be located upstream of the left deck 14*b*, i.e., on a reversed sheet conveying path 31 that connects the sheet feeding path 50 and the surface reversing means 18, as is shown in FIG. 6, and that in any case, a sheet P be prevented from being passed through the recurling unit 32 until image forming on the first surface of the sheet P has been completed.

Compared with the conventional apparatus, the both-face image forming apparatus of this invention employs the recurling means for recurling the sheet in the effective separation direction. Thus, after the image forming means has formed an image on the other surface of the sheet, the sheet can more easily be separated from the photosensitive member than can a sheet in the conventional art.

For the both-face image forming apparatus of this invention, the recurling means is located between the initial curling means, which is positioned on the sheet feeding path leading from the sheet stacking means that is nearest the surface reversing means, and the sheet stacking means. Therefore, for the both-face image forming apparatus, since a sheet fed from the sheet stacking means nearest the surface reversing means is curled by both the recurling means and the initial curing means before an image is formed on one surface of the sheet, the sheet can easily be separated from the photosensitive member.

For the both-face image forming apparatus, since the recurling means is located between the surface reversing means and the sheet stacking means nearest the surface reversing means, the same curling measurement can be provided for all the sheets that are recurled.

For the both-face image forming apparatus of this invention, when the initial curling means and the recurling means each include a roller having a large diameter and a roller having a small diameter for nipping and curling a sheet, or when the roller having a large diameter is more elastic than the roller having a small diameter, or when the roller having a small diameter is made of a hard metal and the roller having a large diameter is made of sponge, the sheet can be curled by pushing a part of the roller having a small diameter into the roller having a large diameter.

For the both-face image forming apparatus of this invention, when the depth to which the roller of the recurling means having a small diameter bites into the roller having a large diameter is greater than the depth to which the roller of the initial curling means having a small diameter bites into the roller having a large diameter, or when the force with which the roller having a small diameter of the recurling means presses against the roller having a large diameter is greater than the force with which the roller having a small diameter of the initial curling means presses against the roller having a large diameter, or when the roller of the recurling means having a large diameter is more elastic than the roller of the initial curling means having a large diameter, or when the diameter of the roller of the recurling means having a small diameter is smaller than the diameter of the roller of the initial curing means having a small diameter, the recurling means can curl a sheet a greater curling distance than does the initial curling means. Thus, the sheet that has been curled by the surface reversing means in the direction in which it is ineffectively separated from the photosensitive member is now curled in the direction in which it can be easily separated.

For the both-face image forming apparatus, since the initial curling means and the recurling means each include a pair of pressing rollers separately positioned in the sheet feeding direction, and one pressed roller that is located between the pair of pressing rollers to receive pressure applied by the pressing rollers, the pair of pressing rollers and the pressed roller can nip and convey the sheet, and at this time, the sheet can be securely curled by the application of a curling force.

For the both-face image forming apparatus of this invention, the distance to which the pressed roller of the recurling means enters the space between the pair of pressing rollers is greater than the distance to which the pressed roller of the initial curling means enters the space between the pair of pressing rollers. Thus, when curling a sheet, the recurling means can provide a greater curling distance than does the initial curling means, and a sheet that has been curled by the surface reversing means in the direction in which it can not be smoothly separated from the photosensitive member can then be securely curled in the direction in which it can be easily separated.

For the both-face image forming apparatus, since the curling capability of the recurling means is greater than the curling capability of the initial curling means, the sheet can be securely curled in a direction in which it can be easily separated from the photosensitive member.

Compared with the conventional apparatus, the both-face image forming apparatus of this invention employs the recurling means for recurling the sheet in the effective separation direction and for flattening the ends of the sheet in the widthwise direction. Thus, after the image forming means has formed an image on the other surface of the sheet, the sheet can more easily be separated from the photosensitive member than can a sheet in the conventional art, and the occurrence of a blank area and a blurred image at the ends of the sheet in the widthwise direction can be reduced.

For the both-face image forming apparatus of this invention, the recurling means is located between the initial curling means, which is positioned on the sheet feeding path leading from the sheet stacking means that is nearest the surface reversing means, and the sheet stacking means. Therefore, for the both-face image forming apparatus, since a sheet fed from the sheet stacking means nearest the surface reversing means is curled by both the recurling means and the initial curing means before an image is formed on one surface of the sheet, the sheet can easily be separated from the photosensitive member.

For the both-face image forming apparatus, since the recurling means is located between the surface reversing means and the sheet stacking means nearest the surface reversing means, the same curling measurement can be provided for all the sheets that are recurled.

For the both-face image forming apparatus, the initial curling means and the recurling means have a roller having a large diameter and a roller having a small diameter for nipping and curling a sheet, and the length of the roller of the recurling means that has a large diameter is shorter than the width of the sheet, and is greater than the length of the roller of the initial curling means that has a large diameter. Therefore, the recurling means can curl the sheet to remove the curl applied by the initial curling means at the widthwise ends of the sheet, and the occurrence of a blank area and a blurred image at the ends of the sheet in the widthwise direction can be reduced.

For the both-face image forming apparatus of this invention, provided at both ends of the roller having a large diameter are holding rollers that contact the roller having a small diameter when the roller having a large diameter is elastically deformed by the roller having a small diameter, and the total length of the roller having a large diameter and the holding rollers, and the length of the roller having a small diameter are set equal to or greater than the width of the sheet. Therefore, when the roller having a large diameter is elastically deformed by the roller having a small diameter, and when in the feeding direction the upstream end and the downstream end of the sheet are curled, the roller having a small diameter can securely feed the sheet by contacting the holding rollers through the widthwise ends of the sheet.

For the both-face image forming apparatus of this invention, when the roller having a large diameter is more elastic than the roller having a small diameter, or when the roller having a small diameter is made of a hard metal and the roller having a large diameter is made of sponge, the sheet can be securely curled by pushing a part of the roller having a small diameter into the roller having a large diameter.

For the both-face image forming apparatus of this invention, when the depth to which the roller of the recurling means having a small diameter bites into the roller having a large diameter is greater than the depth to which the roller of the initial curling means having a small diameter bites into the roller having a large diameter, or when the force with which the roller having a small diameter of the recurling means presses against the roller having a large diameter is greater than the force with which the roller having a small diameter of the initial curling means presses against the roller having a large diameter, or when the roller of the recurling means having a large diameter is more elastic than the roller of the initial curling means having a large diameter, or when the diameter of the roller of the recurling means having a small diameter is smaller than the diameter of the roller of the initial curing means having a small diameter, the recurling means can curl a sheet a greater curling distance than does the initial curling means. Thus, the sheet that has been curled by the surface reversing means in the direction in which it is ineffectively separated from the photosensitive member is now securely curled in the direction in which it can be easily separated.

For the both-face image forming apparatus, since the initial curling means and the recurling means each include a pair of pressing rollers separately positioned in the sheet feeding direction, and one pressed roller that is located between the pair of pressing rollers to receive pressure applied by the pressing rollers, the pair of pressing rollers and the pressed roller can nip and convey the sheet, and at this time, the sheet can be securely curled by the application of a curling force.

For the both-face image forming apparatus of this invention, the distance to which the pressed roller of the recurling means enters the space between the pair of pressing rollers is greater than the distance to which the pressed roller of the initial curling means enters the space between the pair of pressing rollers. Thus, when curling a sheet, the recurling means can provide a greater curling distance than does the initial curling means, and a sheet that has been curled by the surface reversing means in the direction in which it can not be smoothly separated from the photosensitive member can then be securely curled in the direction in which it can be easily separated.

For the both-face image forming apparatus, the length of the pair of pressing rollers of the recurling means is smaller than the width of the sheet, and is greater than the length of the pair of pressing rollers of the initial curling means.

The both-face image forming apparatus employs the recurling means to flatten the widthwise ends of the sheet.

What is claimed is:

1. A duplex image forming apparatus comprising:

sheet stacking means for stacking sheets;

image forming means for forming an image by using a photosensitive member on a sheet that is guided and fed by a sheet feeding path from said sheet stacking means;

initial curling means, positioned on said sheet feeding path, for curling said sheet in a direction away from said photosensitive member when said sheet passes said photosensitive member;

a sheet conveying path for guiding said sheet, on one surface of which an image has been formed by said image forming means, so that said sheet joins into said sheet feeding path;

surface reversing means, positioned on said sheet conveying path, for reversing the surfaces of said sheet; and recurling means, positioned on said sheet conveying path, for curling said sheet in a direction away from said photosensitive member when said sheet past said sheet conveying path passes said photosensitive member, wherein a curling capability of said recurling means is greater than a curling capability of said initial curling means.

2. A duplex image forming apparatus according to claim 1, wherein said recurling means is located between another sheet stacking means that is nearest said surface reversing means, and said sheet feeding path.

3. A duplex image forming apparatus according to claim 1, wherein said recurling means is located between said surface reversing means and said sheet stacking means nearest said surface reversing means.

4. A duplex image forming apparatus according to claim 1, wherein each of said initial curling means and said recurling means has a roller having a large diameter and a roller having a small diameter for nipping and curling the sheet, and wherein said roller having the large diameter is more elastic than said roller having the small diameter.

5. A duplex image forming apparatus according to claim 4, wherein said roller having the small diameter is made of a hard metal, and said roller having the large diameter is made of sponge.

6. A duplex image forming apparatus according to claim 4 or 5, wherein a depth to which said roller of said recurling means having the small diameter interferes with said roller having the large diameter is greater than a depth to which said roller of said initial curling means having the smaller diameter interferes with said roller having the larger diameter.

7. A duplex image forming apparatus according to claim 4 or 5, wherein a force with which said roller having the small diameter of said recurling means presses against said roller having a large diameter is greater than force with said roller having the small diameter of said initial which curling means presses against said roller having the large diameter.

8. A duplex image forming apparatus according to claim 4 or 5, wherein said roller of said recurling means having the large diameter is more elastic than said roller of said initial curling means having the large diameter.

9. A duplex image forming apparatus according to claim 4 or 5, wherein a diameter of said roller of said recurling means having the small diameter is smaller than a diameter of said roller of said initial curling means having the small diameter.

10. A duplex image forming apparatus according to claim 1, wherein each of said initial curling means and said recurling means includes a pair of pressing rollers separately positioned in a sheet feeding direction, and one pressed roller that is located between said pair of pressing rollers to receive pressure applied by said pressing rollers.

11. A duplex image forming apparatus according to claim 10, wherein a distance to which said pressed roller of said recurling means enters a space between said pair of pressing rollers is greater than a distance to which said pressed roller of said initial curling means enters a space between said pair of pressing rollers.

12. A duplex image forming apparatus comprising:

sheet stacking means for stacking sheets;

image forming means for forming an image by using a photosensitive member on a sheet that is guided and fed by a sheet feeding path from said sheet stacking means;

initial curling means, positioned on said sheet feeding path, for curling said sheet in a direction away from said photosensitive member when said sheet passes said photosensitive member;

a sheet conveying path for guiding said sheet, on one surface of which an image has been formed by said image forming means, so that said sheet joins into said sheet feeding path;

surface reversing means, positioned on said sheet conveying path, for reversing the surfaces of said sheet; and recurling means, positioned on said sheet conveying path, for curling side ends of said sheet in a direction away from said photosensitive member when said sheet delivered along said sheet conveying path passes said photosensitive member, wherein said initial curling means does not perform a curling operation at the side ends of said sheet.

13. A duplex image forming apparatus according to claim 12, wherein said recurling means is located between another sheet stacking means that is nearest said surface reversing means, and said sheet feeding path.

14. A duplex image forming apparatus according to claim 12, wherein said recurling means is located between said surface reversing means and said sheet stacking means nearest said surface reversing means.

15. A duplex image forming apparatus according to claim 12, wherein each of said initial curling means and said recurling means has a roller having a large diameter and a roller having a small diameter for nipping and curling the sheet, and wherein a length of said roller of said recurling means that has the large diameter is shorter than a width of said sheet, and is greater than a length of said roller of said initial curling means that has the large diameter.

16. A duplex image apparatus according to claim 15, wherein said roller having the large diameter is more elastic than said roller having the small diameter.

17. A duplex image forming apparatus according to claim 15 or 16, wherein provided at both ends of said roller having the large diameter are holding rollers that contact said roller having the small diameter when said roller having the large diameter is elastically deformed by said roller having the small diameter, and wherein a total length of said roller having the large diameter and said holding rollers, and a length of said roller having the small diameter are set equal to or greater than the width of said sheet.

18. A duplex image forming apparatus according to claim 15 or 16, wherein said roller having the small diameter is made of a hard metal, and said roller having the large diameter is made of sponge.

19. A duplex image forming apparatus according to claim 15 or 16, wherein a depth to which said roller of said recurring means having the small diameter interferes with said roller having the large diameter is greater than a depth to which said roller of said initial curling means having the small diameter interferes with said roller having the large diameter.

20. A duplex image forming apparatus according to claim 15 or 16, wherein a force with which said roller having the small diameter of said recurling means presses against said roller having the large diameter is greater than a force with which said roller having the small diameter of said initial curling means presses against said roller having the large diameter.

21. A duplex image forming apparatus according to claim 15 or 16, wherein said roller of said recurling means having the large diameter is more elastic than said roller of said initial curling means having the large diameter.

22. A duplex image forming apparatus according to claim 15 or 16, wherein the diameter of said roller of said recurling means having the small diameter is smaller than the diameter of said roller of said initial curling means having the small diameter.

23. A duplex image forming apparatus according to claim 12, wherein each of said initial curling means and said recurling means includes a pair of pressing roller separately positioned in a sheet feeding direction, and one pressed roller that is located between said pair of pressing rollers to receive pressure applied by said pressing rollers.

24. A duplex image forming apparatus according to claim 23, wherein a distance to which said pressed roller of said recurling means enters a space between said pair of pressing rollers is greater than a distance to which said pressed roller of said initial curling means enters a space between said pair of pressing rollers.

25. A duplex image-forming apparatus according to claim 23 or 24, wherein a length of said pair of pressing rollers of said recurling means is smaller than a width of said sheet, and is greater than a length of said pair of pressing rollers of said initial curling means.

26. A duplex image forming apparatus according to claim 1, wherein said initial curling means has a first roller and a second roller for nipping and curling the sheet, and said first roller is more elastic than said second roller.

27. A duplex image forming apparatus according to claim 1, wherein said recurring means has a third roller and a fourth roller for nipping and curling the sheet, and said third roller is more elastic than said fourth roller.

28. A duplex image forming apparatus according to claim 1, wherein said initial curling means has a pair of pressing rollers and one pressed roller, and nips the sheet between said pair of pressing rollers and said pressed roller for curling.

29. A duplex image forming apparatus according to claim 1, wherein said recurling means has a pair of pressing rollers and one pressed roller, and nips the sheet between said pair of pressing rollers and said pressed roller for curling.

* * * * *

UNITED STATES PATENT AND TRADEMARK OFFICE

CERTIFICATE OF CORRECTION

PATENT NO. : 6,415,130 B1
DATED : July 2, 2002
INVENTOR(S) : Motohiro Fujiwara et al.

It is certified that error appears in the above-identified patent and that said Letters Patent is hereby corrected as shown below:

Title page,
Item [56], References Cited, FOREIGN PATENT DOCUMENTS, "JP 09-025041 1/1997" should be deleted.

Column 3,
Line 24, "bent," should read -- bend, --.

Column 4,
Line 63, "curing" should read -- curling --.

Column 12,
Line 60, "curing" should read -- curling --.

Column 13,
Line 26, "curing" should read -- curling --.

Column 15,
Line 2, "curing" should read -- curling --.

Column 16,
Line 23, "which" should be deleted.

Column 18,
Line 12, "roller" should read -- rollers --.

Signed and Sealed this

Tenth Day of December, 2002

JAMES E. ROGAN
*Director of the United States Patent and Trademark Office*